US007962987B1

(12) United States Patent
Hannam

(10) Patent No.: US 7,962,987 B1
(45) Date of Patent: Jun. 21, 2011

(54) PORTABLE CURB RAMP

(76) Inventor: Michael T. Hannam, Bixby, OK (US)

( * ) Notice: Subject to any disclaimer, the term of this patent is extended or adjusted under 35 U.S.C. 154(b) by 0 days.

(21) Appl. No.: 12/695,320

(22) Filed: Jan. 28, 2010

(51) Int. Cl.
*B66F 19/00* (2006.01)

(52) U.S. Cl. ..... 14/69.5; 254/88

(58) Field of Classification Search ..... 14/69.5; 254/88

See application file for complete search history.

(56) References Cited

U.S. PATENT DOCUMENTS

| | | | | |
|---|---|---|---|---|
| 5,408,934 | A * | 4/1995 | Hall | 104/257 |
| 6,044,511 | A | 4/2000 | Frost et al. | |
| 6,520,344 | B2 * | 2/2003 | Graham | 211/20 |
| 7,350,255 | B2 * | 4/2008 | Zhang | 14/69.5 |
| 2003/0160221 | A1 * | 8/2003 | Dunbar et al. | 254/88 |
| 2006/0027794 | A1 * | 2/2006 | Heinz | 254/88 |
| 2006/0043350 | A1 * | 3/2006 | Branstetter | 254/88 |
| 2007/0034843 | A1 * | 2/2007 | Reamsnyder et al. | 254/88 |
| 2009/0189130 | A1 * | 7/2009 | Heinz | 254/88 |
| 2010/0096605 | A1 * | 4/2010 | Fick et al. | 254/88 |

FOREIGN PATENT DOCUMENTS

DE 20012041 U1 2/2001

OTHER PUBLICATIONS

Webpage, "Product Catalog—Curb Ramps," Shercom Industries Inc.
Webpage, "Product Catalog—Wheel Chocks," Shercom Industries Inc.
Webpage, "Discount Ramps—Curb-Up,".
Webpage, "Mower Attachments—Curb Jumper Ramp," Walker Mowers.

* cited by examiner

*Primary Examiner* — Raymond W Addie
(74) *Attorney, Agent, or Firm* — Gable Gotwals

(57) ABSTRACT

A portable ramp made according to this invention includes a pair of interconnected ramps for use with high-centering wheeled lawn equipment such as commercial walk-behind mowers. The ramps allow the equipment to move between a first lower elevation and a second higher elevation without its front wheels becoming airborne as the equipment traverses the ramps in a forward direction. The ramps are connected to one another by a flexible tether that allows the distance between the ramps to be easily adjusted and provides a means for stowing the ramps over the handles of the equipment Magnets may be included in a bottom portion of the ramp to provide an optional means for stowing the ramps on the equipment.

10 Claims, 2 Drawing Sheets

PORTABLE CURB RAMP

BACKGROUND OF THE INVENTION

This invention relates to portable ramps and more particularly, portable ramps that allow high centering wheeled lawn equipment, such as commercial walk-behind lawnmowers, to safely and easily traverse over curbs.

Wheeled lawn care equipment, such as commercial walk-behind mowers ("walk-behinds"), zero-turning radius riding mowers and tractors, must sometimes traverse over curbs and other obstructions in order to get to grass cutting and work areas. Traversing curves causes added wear and tear on the equipment and, in many cases, results in damage to the equipment. Traversing curves also places the user at risk of serious injury. Damage and injury are particularly problematic with commercial or large walk-behinds, that is, mowers having mower decks of 30 inches or more. These mowers tend to be "high centering" because the lighter mower deck sits forward of the engine that propels the mower forward and drives the cutting blades. Other types of wheeled lawn equipment, such as riding mowers and tractors, also have this high centering characteristic.

Traversing a curb with a large walk-behind requires that the user "pop-a-wheelie" with the mower, exerting downward force on the handles to lift the front wheels a sufficient height off the ground to clear the curb. Because large walk-behinds are high centering as well as heavy, they are difficult to control, especially as the power-driven rear wheels contact the face of the curb and traverse the curb. Once over the curb, the walk-behind often weaves sand bounces as the front swivel wheels lower and contact (or slam into) the ground.

Newer designs of walk-behind mowers, called "standups" or "right standups," have a deck similar to that of traditional walk-behind mowers but are heavier, with the motor and transmission in a different location. Furthermore, because the user stands on a platform when using the mower, the mower handles are located higher up than those of a traditional walk-behind. The additional weight of the mower combined with the higher handle location makes a standup mower nearly impossible to pop up over a curb.

To solve these problems, some users rely on boards or other ramp-like devices in an attempt to eliminate these problems but boards and similar devices often break slip or slide off of the curb during use, are cumbersome to use, may be set non-parallel to one another or at an improper distance, and are usually not readily accessible when needed because they cannot be stowed on the equipment. More importantly, none of these devices account for the high centering characteristic of the larger walk-behind mowers. Again, the user must often pop-a-wheelie in order to place the front swivel wheels onto the board Several portable ramps have been designed to help wheeled lawn equipment traverse a curb. For example, U.S. Pat. No. 6,044,511, issued to Frost et al. on Apr. 4, 2000, discloses a portable ramp that has a curved bottom designed to allow it to hug the shape of a curve. Ridges on the top surface provide traction and magnets may be attached to or embedded in the bottom surface so the ramp can be removably secured to metal on the top of wheeled vehicles and equipment. Because the ramp is designed to go over the top of the curb, the ramp does not account for the high centering characteristic of large walk-behinds. The front swivel wheels of a large walk-behind remain airborne as the front wheels leave the ramp and the rear wheels continue to traverse the ramp. The ramp also does not allow a user to establish a pre-set distance between the ramps. Users, particularly those in the landscaping and lawn service business, tend to not use ramps if the ramps must be spaced apart and adjusted each time a curb or other obstruction is to be traversed. The lawn care business is a very competitive, cost-conscious, time-sensitive, and transient business. Any task that requires additional cost or time at the job site is simply not done. Additionally, because the ramp requires ridges to provide the necessary traction, the top surface of the ramp traps dirt, oil and debris that lessen the effectiveness of the ridges over time.

The CURB JUMPER™ Ramp (Walker Manufacturing Company, Fort Collins, Colo.), avoids the adjustability problem by providing a single, 40-inch wide ramp that spans the distance between wheels on a 42- and 48-inch riding mower. Although this ramp does not extend over the top of the curb, it includes ridges that collect dirt and debris and is designed to be backed over, making it unsafe for use with a walk-behind. Even if not backed-over, the ramp is not convenient for use with walk-behinds because there is no place on the mower deck to stow such a large ramp. Users in landscaping and lawn service tend to not use a ramp if it cannot be stowed on the equipment and readily accessible for use. The ramp is expensive, making it economically unattractive to landscapers and lawn services that own multiple walk-behind mowers.

The CURB-UP™ Ramp (Discount Ramps.Com, LLC, West Bend, Wis.), is an adjustable lawn tractor metal curb ramp that has a threaded adjustable connecting rod located between the ramps. Although this ramp does not extend over the top of the curb, it can only be stowed on the user's lap while the lawn tractor is in use. The metal edges of the ramp present an additional safety hazard to users. The threaded rod makes the ramp inconvenient for use with walk-behind mowers (there is no "lap" to store it on") and precludes quick changeover to a different between-ramp distance.

Last, some manufacturers are trying to avoid the need for curb ramps altogether by redesigning their walk-behind mowers to provide features that make it easier to "hop" a curb. The Toro Company, for example, advertises a "T-Bar Curb Hopper Design" on its mid-size walk-behind mowers.

SUMMARY OF THE INVENTION

A portable ramp made according to this invention includes a pair of rubber ramps for use with high-centering wheeled lawn equipment. The ramps allow the piece of wheeled lawn equipment to move between a first lower elevation and a second higher elevation without its front wheels becoming airborne as the equipment traverses the ramps in a forward direction.

The ramps are connected to one another by a flexible tether. The flexible tether allows the distance between the ramps to be easily adjusted and provides a means for stowing the ramps over the handles of the lawnmower. The ramp has a substantially smooth sloping contact surface on a top side that provides for traction yet does not accumulate dirt and debris. The first end of the ramp receives the swivel wheels of the walk-behind as the wheels first make contact with the ramp. The second end of the ramp allows the walk-behind to traverse the curb without high centering. Magnets may be included in a bottom portion of the ramp to secure the ramp to the mower deck.

An object of the present invention is to provide an inexpensive portable curb ramp that compensates for the high-centering characteristic of walk-behind mowers. Another object of the invention is to provide a curb ramp that may be easily stowed on the equipment without having to rely upon the mower deck. Yet another object of this invention is to provide a pair of curb ramps that may be quickly adjusted to accommodate a different wheel base. A further object of this invention is to provide a ramp with a top surface that does not accumulate dirt, oil and debris yet provides sufficient traction for a walk-behind to traverse the ramp.

DETAILED DESCRIPTION OF THE PREFERRED EMBODIMENTS

Figure 1:
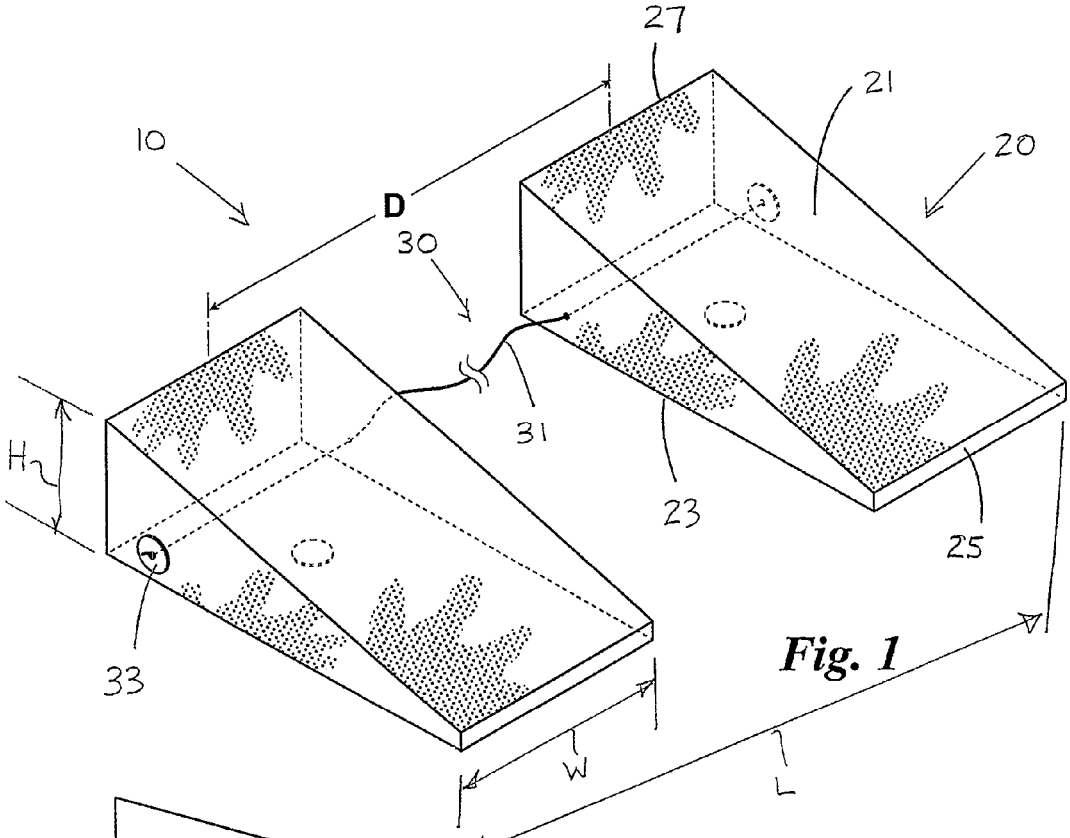
FIG. 1 illustrates an embodiment of a portable curb ramp according to this invention. The portable curb ramp includes a pair of ramps connected by a flexible tether. The tether may be a piece of rope received by a washer and knotted at each end. The length of the tether may be adjusted to provide more or less center-to-center distance between the ramps. The tether also serves as a carrying handle and allows for stowage across the handles of a walk-behind mower.
Figure 2:
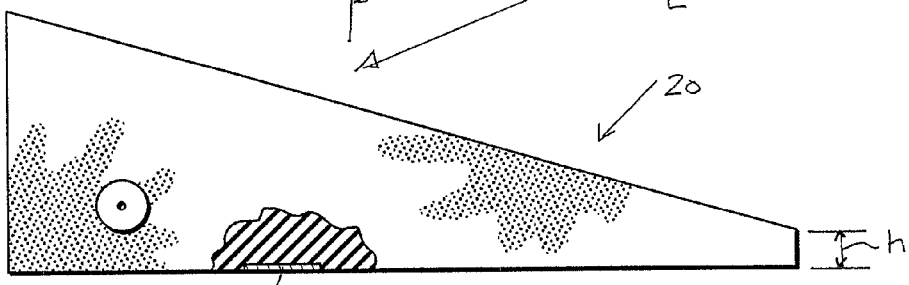
FIG. 2 is a side view of the ramp of FIG. 1. Rather than providing a thin edge at the entry side of the ramp—which does not slow the approach of a wheeled piece of lawn equipment and tends to erode with use—a short wall planar surface is provided. A magnet may reside in the ramp, located near the bottom planar surface of the ramp.
Figure 4:
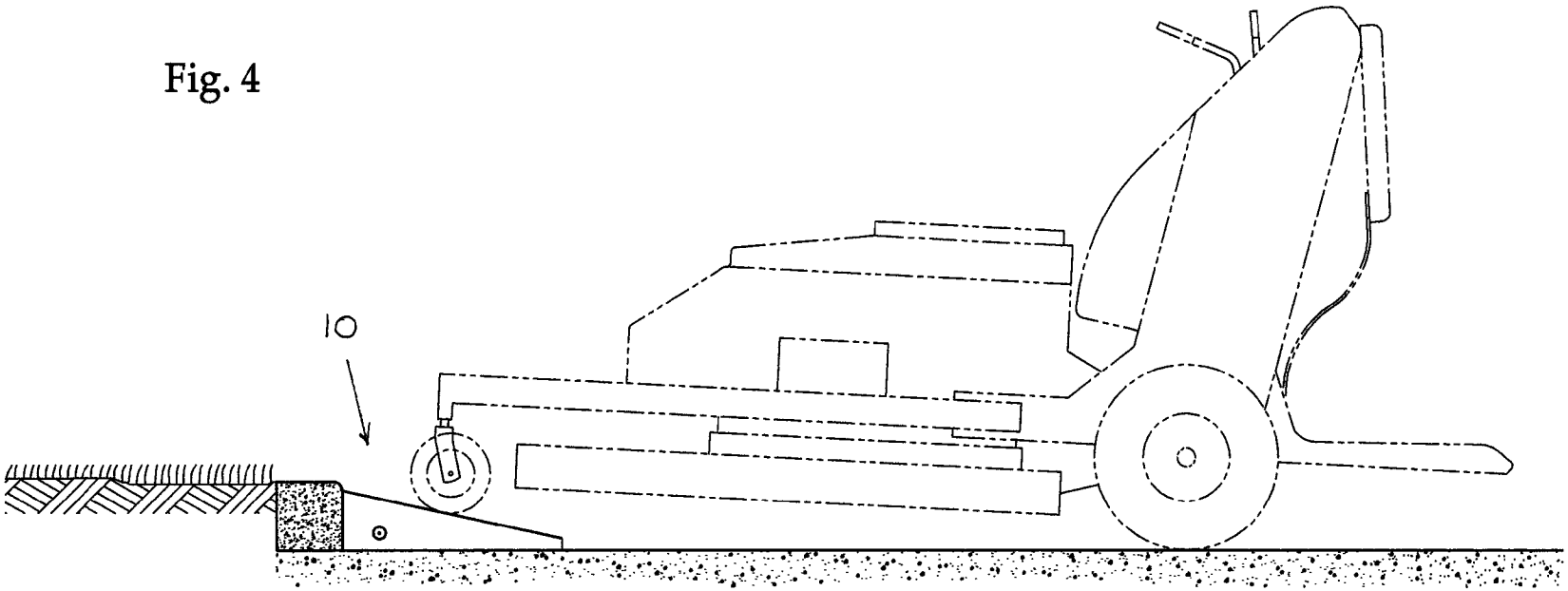
FIG. 4 is a view of the ramp of FIG. 1 as a walk-behind mower uses the ramp to traverse a curb. The curb-side of the ramp, which is shorter in height than the curb, abuts against the curb face and provides for stability of the ramp as the ramp is traversed by a piece of wheeled lawn equipment. The exposed portion of the curb serves as a slight speed bump of sorts to slow the approach of the equipment.

Referring first to FIG. 1, a portable ramp 10 is illustrated that includes a pair of rubber ramps 20 that are connected to one another by a flexible tether 30. Each ramp 20 has a sloping contact surface 21 on its top side, a planar contact surface 23 on its bottom side, and two opposing and substantially parallel ends 25 and 27. Sloping contact surface 21 is preferably a substantially smooth surface having a slope of about 20°. Planar contact surface 23 may include a magnet 29 located residing within an interior portion of the ramp 20. End 25 has sufficient height to receive yet partially slow an oncoming piece of wheeled lawn equipment. About ½-inch height "h" has been found to be effective for this purpose. The shape of end 25 also provides for improved resistance to wear-and-tear caused by wheeled lawn equipment as the wheels of that equipment come into contact with ramp 10. End 27 serves to compensate for the high centering of walk-behind wheeled lawn equipment by exposing an upper portion of the curb when end 27 abuts the face of the curb (see FIG. 4). About a 4½ to 5½ inch height "H" has been found effective for this purpose, with 5 to 5½ inches preferred. The preferred height H to width "W" ratio is about 1:1.

Figure 3:
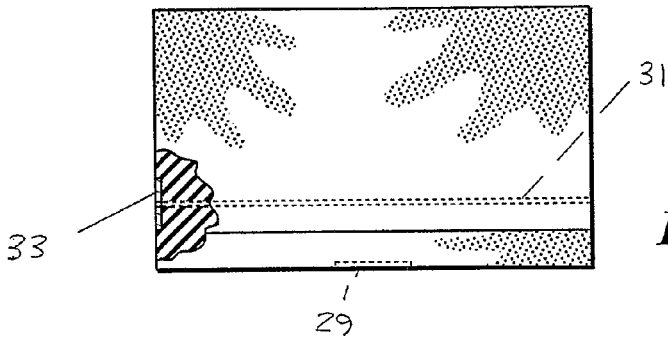
FIG. 3 is an end view of the ramp of FIG. 1. The flexible tether preferably passes through each ramp.

Flexible tether 30, which may be a retractable leash or length of rope 31, preferably passes through an interior portion of each ramp 30 (see also FIG. 3). The length "L" of rope 31 may be adjusted by securing one of its ends and pulling the other end through the opposing ramp 20 until the desired length L is achieved. Alternatively, length L may be adjusted by securing each end of rope 31 and then knotting, tying or clamping (or releasing) an intermediate portion of rope 31. In a preferred embodiment, each end of rope 31 is received by a flat washers 33 and then knotted to prevent the end from passing back through the ramp 20. Tether 30 may be laid across the opposing handles of the walk behind mower for storage during transport of the mower between job sites or while the mower is mowing a lawn.

While preferred embodiments of the portable ramp have been described with a certain degree of particularity, many changes may be made in the details of construction and the arrangement of components without departing from the spirit and scope of this disclosure. A portable ramp according to this disclosure, therefore, is limited only by the scope of the attached claims, including the full range of equivalency to which each element thereof is entitled.

What is claimed is:

1. A portable ramp comprising:

a pair of ramps, each ramp extending in a longitudinal direction and including a sloping contact surface on a top side, a planar contact surface on a bottom side, and two opposing and substantially parallel ends of different height extending between the sloping contact surface and the planar contact surface; and a flexible tether having an adjustable length "L" in communication with and located between the pair of ramps and arranged perpendicular to a central longitudinal axis of each ramp;

the sloping contact surface having a constant slope and spanning the distance between the two opposing and substantially parallel ends, the constant slope selected to allow a piece of wheeled lawn equipment having front and rear wheels to move between a first lower elevation and a second higher elevation without front wheels becoming airborne as the piece of wheeled lawn equipment traverses the pair of ramps in a forward direction the pair of ramps moving between a stowed position on the piece of wheeled lawn equipment to a deployed position off of the piece of wheeled lawn equipment, the flexible tether being a means to maintain the pair of ramps in the stowed position and deploy the pair of ramps from the piece of wheeled lawn equipment and place the pair of ramps at a correct distance for receiving the front wheels.

2. A portable ramp according to claim 1 further comprising a portion of each opposing end of the flexible tether passing through an interior portion of each ramp.

3. A portable ramp according to claim 1 further comprising the sloping contact surface is a substantially smooth surface.

4. A portable ramp according to claim 1 further comprising the sloping contact surface having a constant slope of in a range of about 15 to 25°.

5. A portable ramp according to claim 1 further comprising the two opposing and substantially parallel ends having a difference in height in a range of about 9-to-1 to 11-to-1.

6. A portable ramp according to claim 5 further comprising a height "H" of one of the two opposing and substantially parallel ends being in a range of about 4½ to 5½ inches.

7. A portable ramp according to claim 1 further comprising a height "H" to width "W" ratio of about 1:1, wherein "H" is a height of one of the two opposing and substantially parallel ends and "W" is a width of the planar contact surface.

8. A portable ramp according to claim 1 further comprising each ramp including a magnet, the magnet providing an optional means to maintain each ramp in the stowed position.

9. A portable ramp according to claim 8 further comprising the magnet residing within an interior portion of the ramp and near the planar contact surface on the bottom side.

10. A method for traversing a curb with a piece of wheeled lawn equipment, the method comprising the steps of:

stowing a pair of ramps interconnected by a flexible tether on a piece of wheeled lawn equipment, each ramp in the pair of ramps having a longitudinally extending top side of constant slope that spans the distance between two opposing and substantially parallel ends of different height, the flexible tether being arranged perpendicular to a longitudinal axis of each ramp in the pair of ramps and providing a means by which to stow the pair of ramps on the piece of wheeled lawn equipment;

deploying the pair of ramps for use directly from the piece of wheeled lawn equipment, the flexible tether placing the pair of ramps a distance apart from one another so that in the deployed state each ramp in the pair of ramps is arranged against a curb and in position to receive a front wheel and a rear wheel of the piece of wheeled lawn equipment;

using the pair of ramps to move the piece of wheeled lawn equipment over the curb, the constant slope of the top side of each ramp allowing the piece of wheeled lawn equipment to perform the using step without the front wheels becoming airborne as the piece of wheeled lawn equipment traverses the pair of ramps in a forward direction.

* * * * *